United States Patent [19]

Ziemer et al.

[11] Patent Number: 4,822,476

[45] Date of Patent: Apr. 18, 1989

[54] PROCESS FOR HYDRODEWAXING HYDROCRACKED LUBE OIL BASE STOCKS

[75] Inventors: James N. Ziemer, Hercules; Paul M. Spindler, Novato, both of Calif.

[73] Assignee: Chevron Research Company, San Francisco, Calif.

[21] Appl. No.: 900,943

[22] Filed: Aug. 27, 1986

[51] Int. Cl.[4] ..... C10G 67/04; C10G 69/10

[52] U.S. Cl. ..... 208/59; 208/18; 208/58; 208/87; 208/97; 208/99; 208/111; 208/143

[58] Field of Search ..... 208/18, 58, 68, 97, 208/59, 96, 87, 33, 99, 111, 143; 502/64, 69, 333

[56] References Cited

U.S. PATENT DOCUMENTS

| | | | |
|---|---|---|---|
| 3,617,476 | 11/1971 | Woodle | 208/96 |
| 3,788,976 | 1/1974 | Kirk, Jr. | 208/18 |
| 3,793,190 | 2/1974 | Nastast et al. | 208/18 |
| 3,894,937 | 7/1975 | Bonacci et al. | 208/58 |
| 3,923,636 | 12/1975 | Mead et al. | 208/58 |
| 3,989,617 | 11/1976 | Yan | 208/111 |
| 4,011,154 | 3/1977 | Strangeland et al. | 208/18 |
| 4,176,050 | 11/1979 | Chen et al. | 208/111 |
| 4,181,598 | 1/1980 | Gillespie et al. | 208/18 |
| 4,191,632 | 3/1980 | Cosyns et al. | 208/59 |
| 4,213,847 | 7/1980 | Chen et al. | 208/59 |
| 4,269,695 | 5/1981 | Silk et al. | 208/46 |
| 4,283,271 | 8/1981 | Garwood et al. | 208/59 |
| 4,325,805 | 4/1982 | Miller | 208/18 |
| 4,347,121 | 8/1982 | Mayer et al. | 208/18 |
| 4,361,477 | 11/1982 | Miller | 208/58 |
| 4,414,097 | 11/1983 | Chester et al. | 208/95 |
| 4,437,975 | 3/1984 | Gillespie et al. | 208/97 |
| 4,574,043 | 3/1986 | Chester et al. | 208/97 |
| 4,597,854 | 7/1986 | Penick | 208/58 |
| 4,601,996 | 7/1986 | Miller | 208/143 |
| 4,605,488 | 8/1986 | Chester et al. | 208/97 |
| 4,622,129 | 11/1986 | Bayle et al. | 208/87 |
| 4,622,130 | 11/1986 | Stem | 208/33 |
| 4,627,908 | 12/1986 | Miller | 208/143 |
| 4,657,661 | 4/1987 | Miller | 208/58 |
| 4,673,487 | 6/1987 | Miller | 208/58 |
| 4,678,556 | 7/1987 | Hicks et al. | 208/96 |

FOREIGN PATENT DOCUMENTS

| | | | |
|---|---|---|---|
| 0142353 | 6/1980 | German Democratic Rep. | 208/58 |

*Primary Examiner*—Anthony McFarlane

*Attorney, Agent, or Firm*—S. R. La Paglia; T. G. De Jonghe; V. J. Cavalieri

[57] ABSTRACT

We disclose a single stage, multilayered catalyst system capable of hydrodewaxing and hydrofinishing a solvent-dewaxed lube oil base stock. In the first layer we catalytically dewax the solvent-dewaxed stock. In the second layer we hydrofinish the catalytically dewaxed stock. Our invention also relates to a process for hydrodewaxing and hydrofinishing a solvent-dewaxed lube oil base stock.

4 Claims, 2 Drawing Sheets

PROCESS FOR HYDRODEWAXING HYDROCRACKED LUBE OIL BASE STOCKS

BACKGROUND OF THE INVENTION

The present invention relates to a single stage, multilayered catalyst system for hydrodewaxing and hydrofinishing a hydrocracked, solvent dewaxed lube oil base stock. In the first layer, the hydrocracked, solvent dewaxed stock is catalytically dewaxed, using, for example, an aluminosilicate catalyst. In the second layer, the catalytically dewaxed stock is hydrofinished using, for example, a palladium hydrotreating catalyst having an alumina or siliceous matrix.

This invention also relates to a process for hydrodewaxing and hydrofinishing a hydrocracked, solvent dewaxed lube oil base stock. The process comprises contacting the base stock with hydrogen in the presence of the multilayered catalyst system. Specifically, we have found that by using high space velocity rates and a high hydrogen partial pressure, both hydrodewaxing and hydrofinishing are accomplished in a single process step using the layered catalyst system with minimum yield, VI, and pour point loss.

It is well known in the art to form various lubricating oils from hydrocarbon fractions derived from petroleum crudes. The process of refining to isolate a lubricant base stock consists of a set of unit operations to remove or convert the unwanted components. They may include, for example, distillation, hydrocracking, dewaxing, and hydrogenation.

It often occurs in the course of refining a lube oil that a product is made to specification except for some deficiency resulting from contamination by a small amount of high melting wax. For example, a refined oil may be prepared that has a satisfactory pour point and cloud point, but upon storage, a wax haze develops that makes the oil commercially unacceptable.

When this haze occurs, the refiner suffers a severe economic penalty because the haze is usually discovered only after all the raw material and process costs have been expended to make the product. At this time, there is no effective and economic process to remove the small amounts of contaminating wax, present in amounts less than 2.0 weight percent. These contaminated oils generally cannot be mixed with other oils to make a commercially acceptable blend. Thus, there is no market or use for these contaminated oils other than feeding them to a catalytic cracking unit or burning them as heavy fuel oil.

In recent years, workers in the field have proposed various processes to catalytically dewax petroleum oils. For example: U.S. Pat. No. 3,755,138 (hydrodewaxing intermediate pour point solvent dewaxed lube oils for further pour point reduction); U.S. Pat. No. 4,181,598 (catalytic dewaxing, followed by hydrofinishing of solvent refined lube oils to produce low pour point, high stability lube oils); and U.S. Pat. No. 4,269,695 (catalytic hydrodewaxing of poorly dewaxed lube oils over a zerolite catalyst). We have found, however, that these processes are not completely satisfactory.

Because of high fluctuations in sulfur and nitrogen levels, all of these processes require relatively low liquid hourly space velocities (LHSV), less than 10 hr.$^{-1}$. Moreover, if dewaxing is done after hydrofinishing, the oxidation stability of the lube oil may be affected. So as a practical result, the catalystic dewaxing must be accomplished separately from other processes such as hydrofinishing. Accordingly, it is the principal object of the invention to accomplish both step. This is accomplished at a relatively high LHSV and high hydrogen partial pressure in order to combine both processes.

It has now been discovered that by using a multilayered catalyst system, an LHSV greater than 4 hr.$^{-1}$, with respect to the dewaxing catalyst and hydrogen partial pressure greater than 500 psia, hydrocracked, solvent dewaxed lube oil base stocks can be catalytic dewaxed and hydrofinished in a single process step. Thus, the present invention yields increased process efficiencies and reduced capital costs.

SUMMARY OF THE INVENTION

The invention concerns a multilayer, single stage catalyst system capable of hydrodewaxing and hydrofinishing a hydrocracked solvent dewaxed lube oil base stock. The system comprises two catalyst layers. The first layer comprises a fixed bed of catalyst particles having dewaxing activity; the second layer comprises a fixed bed of catalyst particles having hydrogenation activity under mild conditions.

In accordance with this invention, a process is disclosed for hydrodewaxing and hydrofinishing a hydrocracked solvent dewaxed lube oil base stock using the multilayered catalyst system. The process comprises passing the stock, in the presence of hydrogen, through the first and second layers of catalyst particles at hydroprocessing conditions.

In a preferred embodiment, the hydroprocessing conditions comprise an LHSV greater than 10 with respect to dewaxing catalyst and a hydrogen partial pressure ranging from about 1000 psia to about 2500 psia.

DETAILED DESCRIPTION OF THE INVENTION

Figure 1:
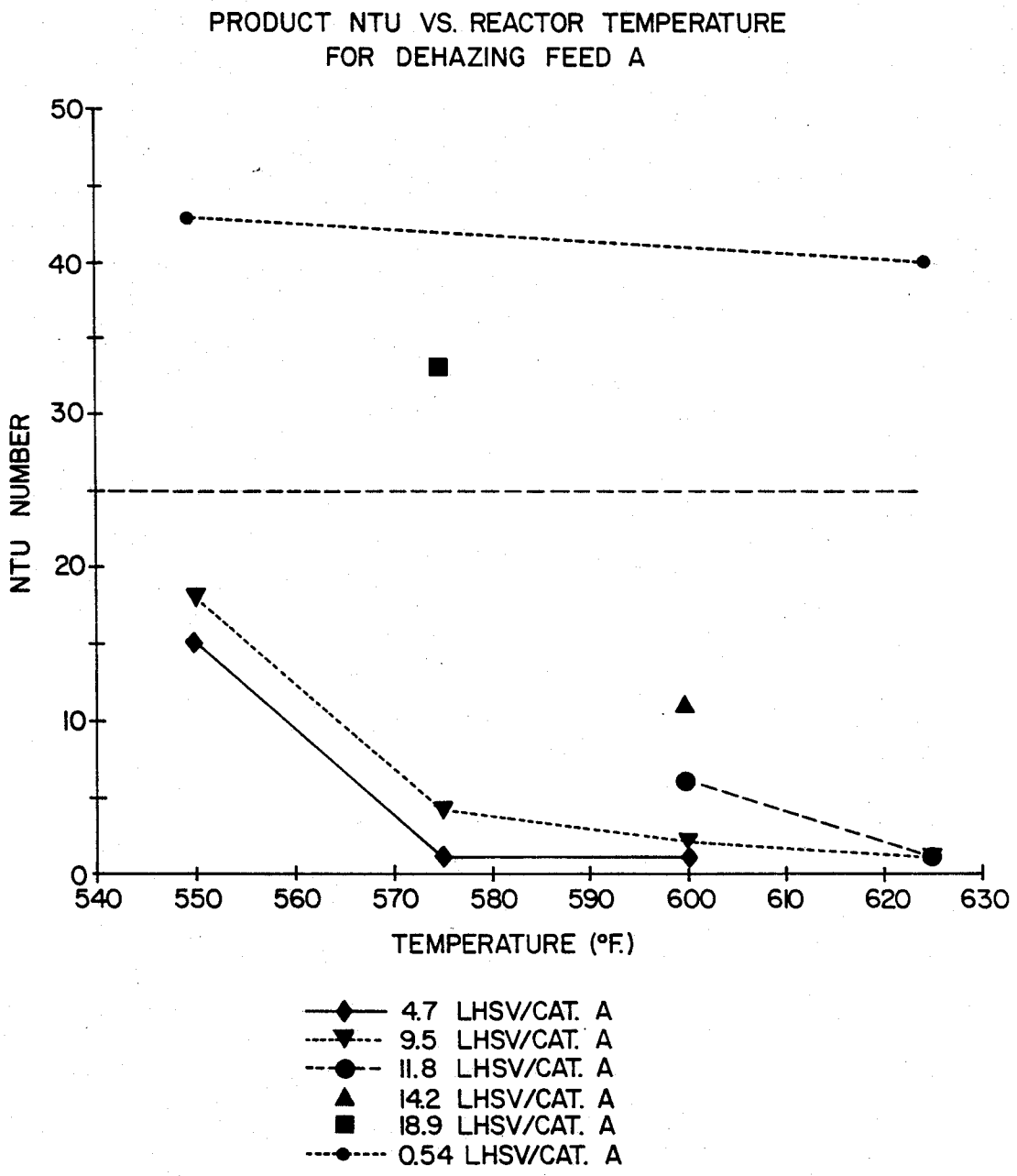
FIG. 1 shows product NTU plotted as a function of reactor temperature and compares the present invention to only a hydrofinishing catalyst.

The hydrocarbonaceous feeds, from which we obtain the hydrocracked lube oil base stocks used in the process of this invention, usually contain aromatic and naphthenic compounds as well as normal and branched paraffins of varying chain lengths. These feeds usually boil in the gas oil range. We prefer feedstocks such as hydrocracked vacuum gas oils (VGO) with low viscosity indexes (VI) and normal boiling ranges above about 350° C. and below about 600° C., and deasphalted hydrocracked residual oils having normal boiling ranges above about 480° C. and below about 650° C. We can also use hydrocracked reduced topped crude oils, shale oils, liquefied coal, coke distillates, flask or thermally cracked oils, atmospheric residua, and other heavy oils as the feed source, so long as the total nitrogen level is below 50 ppm.

Typically, we hydrocrack the hydrocarbonaceous feed, preferably VGO, using standard reaction conditions and catalysts in one or more reaction zones. The resulting hydrocracked lube oils are low in multi-ring aromatic and naphthenic molecules, and have a VI greater than 95. In addition, such oils are low in sulfur, less than 20 ppm, and nitrogen, less than 20 ppm.

Next, we solvent-dewax the hydrocracked base stock to a pour point of less than 15° F., using conventional solvent dewaxing procedures and apparatus. Suitable solvents include, for example, methyl ethyl ketone. The lube oil base stock preferably less than 2.0 wt. % wax, less than 20 ppm nitrogen, and less than 20 ppm sulfur.

In the present process, we contact the hydrocracked, solvent dewaxed base stock with a multilayered catalyst system, in the presence of hydrogen, at a high LHSV and at high hydrogen partial pressure. The first catalyst layer in the system comprises a dewaxing catalyst and the second catalyst layer comprises a hydrofinishing catalyst.

We select suitable dewaxing catalysts from conventional catalystic dewaxing processes. For example, suitable crystalline aluminosilicate zeolites are detailed in U.S. Pat. No. 4,269,695, granted May 26, 1981, to Silk et al which is herein incorporated by reference. Of particular importance is our selection of a catalyst that has high selectivity, as reflected by its "Constraint Index".

The Constraint Index (CI) is defined in U.S. Pat. No. 4,269,695 (previously incorporated by reference). In general, the higher the CI, the higher the selectivity. In the present process, we can use catalysts having a CI ranging from about 0.4 to about 15, preferably from about 12 to about 15.

In the second layer of the catalyst system, we hydrofinish the catalytically dewaxed stock using a mild hydrogenation catalyst. We select suitable catalysts from conventional hydrofinishing catalysts having hydrogenation activity. Because we hydrofinish under relatively mild conditions, we prefer to use a less active hydrogenation catalyst. For example, a noble metal from Group VIIIA according to the 1975, rules of the International Union of Pure and Applied Chemistry, such as palladium, on an alumina or siliceous matrix, or unsulfided Group VIIIA and Group VIB, such as nickel-molybdenum or nickel-tin, is a suitable catalyst. U.S. Pat. No. 3,852,207 granted Mar. 26, 1973, to Stangeland et al, describes a suitable noble metal catalyst and mild conditions, and is herein incorporated by reference. Other suitable catalysts are detailed, for example, in U.S. Pat. No. 4,157,294, and U.S. Pat. No. 3,904,513.

Typical hydrodewaxing and hydrofinishing conditions which we found useful in the present process vary over a fairly wide range. In general, the overall LHSV is about 0.25 to about 2.0; preferably about 0.5. The specific hydrodewaxing LHSV is greater than 4 $hr.^{-1}$, preferably from about 10 $hr.^{-1}$ to about 15 $hr.^{-1}$; hydrogen partial pressure is greater than 500 psia, preferably ranging from about 1000 psia to about 2500 psia; temperatures range from about 550° F. to about 650° F., preferably from about 580° F. to about 600° F.; pressures range from about 500 psig to about 3000 psig, preferably from about 1500 psig to about 2500 psig; and hydrogen circulation rate range from about 3000 SCF/bbl to about 15,000 SCF/bbl, preferably ranging from about 5000 SCF/bbl to about 7000 SCF/bbl.

The advantages of using a high LHSV and high hydrogen partial pressure in the present invention are manifold. It allows us to use dewaxing and hydrofinishing catalysts in the same reactor at identical conditions. In general, hydrofinishing and dewaxing catalysts have widely varying fouling rates. But by using increased hydrogen partial pressures, the fouling of both catalysts, particularly the hydrofinishing catalysts, are greatly reduced and are, in effect, normalized to approximately equal fouling rates. In addition, the high hydrogen partial pressure allows the dewaxing catalyst to be absent of any hydrogenation components. Thus, we can recharge both layers of catalysts simultaneously and therefore efficiently use them in the same process step.

Moreover, in the present invention, we hydrodewax and hydrofinish without altering the physical properties of the lube oil base stock. Because the hydrocracked stock contains relatively low levels of nitrogen and sulfur, little catalyst poisoning occurs. Thus, we can use a dewaxing catalyst, having a low activity (a silica to alumina ratio greater than 200), under mild conditions. By subjecting the stock to such mild conditions, we noticed no appreciable change in viscosity, VI, or pour point and less than 3.0% loss in yield with respect to the hydrofinishing catalyst alone. Finally, because we hydrodewax and hydrofinish in one stage, we do not suffer a loss in product oxidation stability which occurs when we hydrodewax after hydrofinishing.

We exemplify below these advantages, as well as other advantages of the present invention. We intend the examples to illustrate representative embodiments of the invention and results which we have obtained in laboratory analysis. Those familiar with the art will appreciate that other embodiments of the invention will provide equivalent results without departing from the essential features of the invention.

EXAMPLES

We used three catalysts in the tests described hereinafter. We identify them as Catalysts A, B, and C.

Catalyst A, a dewaxing catalyst, comprised of 65% HZSM-5 with an $SiO_2/Al_2O_3$ ratio of 200:1 and with 35% alumina binder in the form of crushed extrudate sized from 18 to 42 mesh. Details of preparing it are disclosed in U.S. Pat. No. 3,968,024 to Gorring et al., issued July 6, 1976, which is incorporated by reference.

Catalyst B, a dewaxing catalyst, is similar to Catalyst A, but is impregnated with 1 wt. % platinum loading. We added 12 grams of crushed extrudate to a solution of 37 mls of methylalcohol, 24 mls $H_2O$, and 0.25 grams of $Pt(NO_3)_2(NH_3)_4$. We slowly removed the solution by tumbling under a vacuum. Next, we transferred the catalyst to a vacuum oven and slowly heated it to 250° F. for 12 hours. We then calcined the dried catalyst in air at 250° F., 450° F., and 900° F. for intervals of two hours each. Details of preparing it are disclosed in U.S. Pat. No. 4,269,695 to Silk et al., issued May 26, 1981, which is incorporated by reference.

Catalyst C, a commercial hydrofinishing catalyst, comprised 0.6 wt. % platinum on a $SiO_2$:$Al_2O_3$ base in the form of crushed extrudate sized from 18 to 42 mesh. Details of preparing it are disclosed in U.S. Pat. No. 4,162,962 to Stangeland, issued July 31, 1979, which is incorporated by reference.

In the tests that follow, we used two analytical tests for guaging the performance of the catalyst system.

We used the "OXIDATOR BN" test to determine oxidation stability. This is a standard analytical test which is fully described in U.S. Pat. No. 3,852,207 to *Stangeland,* issued Mar. 26, 1973, previously incorporated by reference.

The "NTU Index" is a Chevron-developed, quantitative test for the wax remaining in heavy neutral oil after solvent dewaxing. Residual wax is precipitated by solvent and quantitated by nephelometric turbidity. Results from the test are reported in Nephelometric Turbidity Units (NTU) and correlate quite well with the visual appearance of hydrofinished oils stored at room temperature. Based on the appearance of reference oils, the maximum turbidity rating allowable for commercial oils is 24. Gas chromatographic analysis of the isolated material shows characteristics similar to refined waxes made from waxy heavy neutral.

The NTU test relies on the precipitation of wax upon addition of 50° F. methyl ethyl ketone (MEK). Visual inspection can distinguish qualitatively between amounts of wax in the MEK/oil solution, but quantitation requires that the wax be separated by filtration from the oil, and then redissolved and reprecipitated in MEK to measure turbidity.

The following is the method that we used;

We weighed 25.0 grams of contaminated oil into a 500 ml erlenmeyer flask and added 375 ml (measured at 70° F.) of methyl ethyl ketone (MEK) prechilled at 50° F. We stirred it for 15 minutes while maintaining the temperature of the mixture at 50° F. After 15 minutes, we quickly filtered the solution by vacuum over a 5.5 cm Whatman Grade 2 filter paper, making sure that the liquid level over the filter never built up higher than 0.25 inches (this prevents some of the wax from adhering to the funnel walls). When all the solution had been filtered, we maintained suction on the filter for 10–15 seconds after all the liquid was drained off to ensure that the filter paper is free of oil from the first solution.

We set up another filtration apparatus using a 250-ml filtration flask. We placed a clean 8-dram vial in the filtration flask and transferred the wax containing filter paper from the first filtration to the second filtration setup. We poured 23 mls of boiling MEK (175° F.) over the waxy filter with no vacuum and collected all the filtrate in the 8-dram vial. We removed the 8-dram vial and capped tightly with a plastic cap containing a polyethylene cone liner. We inserted a second vial into the filter flask and repeated the filter washing with another 23 ml quantity of boiling MEK. (Note: if the first wash is done correctly, the second wash should have negligible wax.)

We placed both vials in ice water for three minutes. We removed and allowed both vials to come to 68°–72° F. We shook the vials vigorously for five to eight seconds and placed them in a Hach Model 18900 ratio turbidimeter which had been previously calibrated with an 18 NTU formazin standard. We allowed 10–15 seconds for the instrument to stabilize and recorded the average reading at the lowest instrument setting over the next 10 seconds. We measured the turbidity on each vial twice and summed the average readings for the first wash with the average readings with the second wash. We rounded off to the nearest whole number and reported this as the NTU index.

EXAMPLE 1

We carried out a series of experiments in a trickle bed miniature pilot plant to demonstrate the advantages of the present invention. We loaded 0.61 grams of Catalyst A directly over 3.17 grams of Catalyst C into a ⅜ inch stainless steel reactor to give a total volume of 7.47 cc. We filled the remaining dead volume of the reactor with 24–42 mesh inert allundum. We preconditioned the catalysts by passing dry nitrogen in situ at 250° F. and 1000 psig for 30 minutes at a rate of 60 cc/min. We then switched the gas to hydrogen and maintained at 300° F. for one hour. Following this, we pressured the unit to 2150 psig under flowing hydrogen at 60 cc/min. and increased temperature 50° F. every 30 minutes until we reached 550° F. We maintained this for 1.5 hours before we introduced the hydrocarbon feed.

The feed that we used to condition the catalysts was a 900°–1100° F. boiling point, hydrocracked and solvent dewaxed heavy neutral oil, spiked with 130 ppm n-butylamine. Table 1 gives the inspections for Feed A.

TABLE I

Properties of Heavy Neutral Feeds Used in Examples 2–6

| | Feed A | Feed B | Feed C |
|---|---|---|---|
| Gravity, Spec. @ 20° C. | .8681 | .8725 | .8661 |
| Pour Point, °F. | +5 | +5 | +15 |
| Cloud Point, °F. | | | +18 |
| Viscosity @ 40° C., cSt | 89.55 | 94.25 | 92.27 |
| Viscosity @ 100° C., cSt | 10.85 | 10.90 | 10.97 |
| Viscosity Index | 105 | 100 | 104 |
| Sulfur, ppm | 4.56 | 4.15 | 5.89 |
| Nitrogen, ppm | .48 | .64 | .50 |
| Oxidator BN | | 10.75 | 20.12 |
| NTU index | 43 | 270 | |
| TPG Dist, LV %, °F. | | | |
| St | 746 | 739 | 757 |
| 5 | 821 | 810 | 821 |
| 10 | 853 | 841 | 852 |
| 30 | 915 | 903 | 912 |
| 50 | 953 | 940 | 949 |
| 70 | 987 | 974 | 984 |
| 70 | 987 | 974 | 984 |
| 90 | 1031 | 1020 | 1029 |
| 95 | 1055 | 1045 | 1054 |
| 99 | 1112 | 1105 | 1113 |

We ran Feed A at 4 cc/hr for a period of 12 hours. Our purpose of using a butylamine spiked feed during the initial break-in period was to rapidly deactivate and condition the catalysts so that their activity would more closely resemble a catalyst with several hundred hours onstream.

Following this period, we contacted the layered catalyst system with unadulterated Feed A. This demonstrates the system's ability to dehaze 43 NTU wax-contaminated-feed to an acceptable level (below 25 NTU) at space rates of 4.7 to 9.46 $hr^{-1}$ with respect to Catalyst A. FIG. 1 and Table II display our results.

TABLE II

Properties of Hydrofinished Heavy Neutral Oil Using Feed A

| | | | | | |
|---|---|---|---|---|---|
| Hours on Stream | 70 | 21 | 117 | 140 | 171 |
| Reactor Temp., °F. | 550 | 550 | 600 | 600 | 625 |
| Wt. % Lube Yield | 99.0 | 99.4 | 99.1 | 99.5 | 97.9 |
| LHSV,/hr (wrt Cat. A) | 4.7 | 9.5 | 9.5 | 14.2 | 11.8 |
| LHSV,/hr (overall) | 0.54 | 1.07 | 1.07 | 1.62 | 1.35 |
| NTU index | 15 | 18 | 2 | 11 | 1 |
| Viscosity @ 40° C., cSt | 90.95 | 89.91 | 88.56 | 88.56 | 87.86 |
| Viscosity @ 100° C., cSt | 10.91 | 10.90 | 10.77 | 10.77 | 10.71 |

EXAMPLE 2

In this example, we ran Catalyst C alone to demonstrate that a hydrofinishing catalyst by itself is unable to reduce NTU content of a wax-contaminated-feed. FIG. 1 and Table III display our results.

TABLE III

Properties of Hydrofinished Heavy Neutral Oil Using Feed A, Catalyst C Only

| | | |
|---|---|---|
| Hours on Stream | 64 | 136 |
| Reactor Temp., °F. | 550 | 625 |
| LHSV,/hr (overall) | 0.54 | 0.54 |
| Wt. % Lube Yield | 98.9 | 96.9 |
| NTU | 43 | 40 |

EXAMPLE 3

Figure 2:
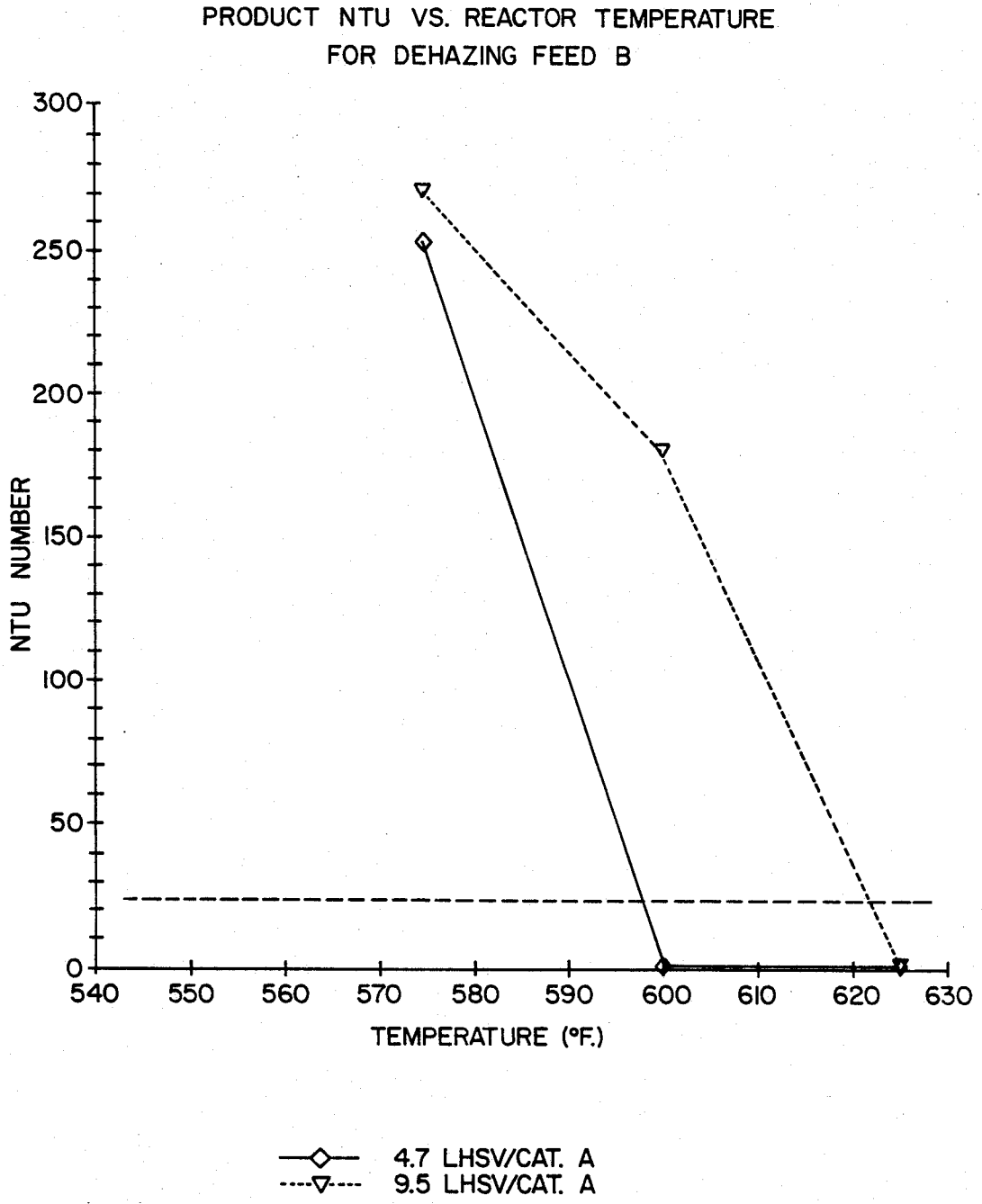
FIG. 2 shows product NTU plotted as a function of reactor temperature for a 270 NTU hydrocracked, solvent dewaxed heavy neutral oil.

In this example, we contacted the catalyst system of Example 1 with Feed B whose inspections are set out in Table I. It was a 270 NTU hydrocracked, solvent-dewaxed heavy neutral oil. We used the same process conditions as in Example 1. We raised the temperature to 600° F. and 625° F., at space rates of 4.73 $hr^{-1}$ and 9.46 $hr^{-1}$, relative to Catalyst A, we found the high NTU feed to be completely dehazed. Furthermore, we found there was no significant loss of product, product viscosity, or product VI at these conditions. FIG. 2 and Table IV disclose these results.

TABLE IV

Properties of Hydrofinished Heavy Neutral Oil Using Feed B

| | | |
|---|---|---|
| Hours on Stream | 473 | 402 |
| Reactor Temp., °F. | 600 | 625 |
| LHSV,/hr (wrt Cat. A) | 4.7 | 9.5 |
| LHSV,/hr (overall) | 0.54 | 1.07 |
| Wt. % Lube Yield | 97.6 | 98.1 |
| NTU Index | 1 | 1 |
| Viscosity @ 40° C., cSt | 93.11 | 92.24 |
| Viscosity @ 100° C., cSt | 10.82 | 10.73 |
| Viscosity Index | 100 | 99 |

EXAMPLE 4

In this example, we demonstrate the deleterious effect on lube oil oxidation stability when a dewaxing catalyst is used separately without concurrent hydrofinishing.

We contacted Feed C, whose inspections are described in Table 1, with 0.66 grams of Catalyst B under the same conditions as Example 1. Feed C is a hydrocracked, solvent-dewaxed, hydrofinished heavy neutral lube oil with an oxidation stability of 20 hours. The results disclosed in Table V, demonstrate that even when a dewaxing catalyst contains an active hydrogenation component, like 1 wt. % platinum, a substantial loss in lube oil oxidation stability results when only a dewaxing catalyst is used for wax haze reduction. This stability loss becomes more pronounced as we raised catalyst temperature from 550° F. to 625° F.

TABLE V

Properties of Hydrofinished Heavy Neutral Oil Using Feed C, Catalyst B

| | | |
|---|---|---|
| Hours on Stream | 47 | 73 |
| Reactor Temp., °F. | 550 | 625 |
| LHSV,/hr | 4.7 | 4.7 |
| Wt. % Lube Yield | 94.6 | 82.2 |

TABLE V-continued

Properties of Hydrofinished Heavy Neutral Oil Using Feed C, Catalyst B

| | | |
|---|---|---|
| Viscosity @ 40° C., cSt | 97.75 | 95.96 |
| Viscosity @ 100/° C., cSt | 11.20 | 10.72 |
| Viscosity Index | 100 | 94 |
| Oxidator BN | 15.9 | 6.5 |

What is claimed is:

1. A process for hydrodewaxing and hydrofinishing a hydrocracked, solvent dewaxed lube oil base stock which comprises:

passing said stock, in the presence of hydrogen, through a multilayer single stage catalyst system, said catalyst system comprising:

(a) a first catalyst layer comprising a fixed bed of catalyst particles having dewaxing activity said catalyst comprising a crystalline aluminosilicate having a constraint index ranging from about 0.4 to about 15;

(b) a second catalyst layer in contact with said first layer comprising a fixed bed of catalyst particles having hydrogenation activity under hydrofinishing conditions wherein said second catalyst comprises at least one Group VIIIA noble metal supported on an alumina or siliceous matrix, under dewaxing and hydrofinishing conditions, and obtaining a product having a Nephelometric Turbidity Units (NTU) Index of 24 or less wherein said NTU Index is a measure of wax remaining in the oil after solvent dewaxing.

2. A process according to claim 1 wherein said dewaxing and hydrofinishing conditions comprise:

(a) a space velocity (LHSV) greater than 4; and (b) a hydrogen partial pressure greater than 500 psia.

3. A process according to claim 2 wherein said dewaxing and hydrofinishing conditions comprise:

(a) a space velocity (LHSV) ranging from about 10 to about 15;

(b) a hydrogen partial pressure ranging from about 1000 psia to about 2500 psia;

(c) a hydrogen circulation rate ranging from about 5000 to about 7000 to standard cubic feed for barrel of feed (SCF/bbl);

(d) a temperature ranging from about 550° F. to about 650° F.; and (e) a pressure ranging from about 1500 psig to about 3000 psig.

4. A process according to claim 3 wherein said hydrocracked solvent dewaxed lube oil base stock comprises a sulfur level of less than 20 ppm, a nitrogen level of less than 20 ppm, and wax level of less than 2.0 wt. %.

* * * * *